US005217757A

United States Patent [19]

Milaniak et al.

[11] Patent Number: 5,217,757

[45] Date of Patent: Jun. 8, 1993

[54] METHOD FOR APPLYING ALUMINIDE COATINGS TO SUPERALLOYS

[75] Inventors: Walter E. Olson, Vernon; Michael S. Milaniak, Middlefield; Clark T. Okawa, West Haven, all of Conn.

[73] Assignee: United Technologies Corporation, Hartford, Conn.

[21] Appl. No.: 926,273

[22] Filed: Nov. 3, 1986

[51] Int. Cl.[5] ..... C23C 10/48

[52] U.S. Cl. ..... 427/253

[58] Field of Search ..... 421/253

[56] References Cited

U.S. PATENT DOCUMENTS

| | | | |
|---|---|---|---|
| 3,079,276 | 2/1963 | Puyear et al. | 117/107.2 |
| 3,257,230 | 6/1966 | Wachtell et al. | 117/107.2 |
| 3,276,903 | 10/1966 | Galmiche | 117/107.2 |
| 3,667,985 | 6/1972 | Levine et al. | 117/22 |
| 3,801,353 | 4/1974 | Brill-Edwards | 117/71 |
| 3,837,901 | 9/1974 | Seybolt | 117/107.2 |
| 3,904,789 | 9/1975 | Spiers | 427/253 |
| 3,958,047 | 5/1976 | Baldi | 427/252 |
| 4,132,816 | 2/1979 | Benden et al. | 427/237 |
| 4,142,023 | 2/1979 | Bornstein et al. | 428/680 |
| 4,148,275 | 4/1979 | Benden et al. | 118/49.5 |
| 4,293,338 | 10/1981 | Rose | 427/253 |
| 4,332,843 | 6/1982 | Ahuja | 427/237 |

OTHER PUBLICATIONS

G. W. Goward et al, "Formation and Degradation Mechanisms of Aluminide Coatings on Nickel-Base Superalloys," Transactions of the ASM, vol. 60, 1967, pp. 228-241.

K. Godlewski et al, "Effect of Chromium on the Protective Properties of Aluminide Coatings," Oxidation of Metals, vol. 26, Nos. 1/2, 1986, pp. 125-138.

*Primary Examiner*—Sam Silverberg

*Attorney, Agent, or Firm*—James M. Rashid

[57] ABSTRACT

A powder mixture for applying gas phase aluminide coatings to nickel or cobalt base superalloys is described. A preferred mixture consists essentially of $Co_2Al_5$, $NH_4F.HF$, and chromium metal. The mixture is substantially free of aluminum oxide.

9 Claims, 2 Drawing Sheets

METHOD FOR APPLYING ALUMINIDE COATINGS TO SUPERALLOYS

TECHNICAL FIELD

This invention relates to aluminide coatings, and in particular, to gas phase aluminide coatings.

BACKGROUND

Aluminide coatings provide protection against oxidation and corrosion degradation to nickel and cobalt base superalloy articles used in gas turbine engines. U.S. Pat. Nos. which are indicative of the skill in the art relative to aluminide coatings include the following: 3,079,276, 3,276,903, 3,667,985, 3,801,353, 3,837,901, 3,958,047, 4,132,816, 4,142,023, 4,148,275 and 4,332,843. In general, aluminide coatings are formed by heating a powder mixture containing a source of aluminum, an activator, and an inert buffer or diluent, in the presence of the article to be coated. The article may either be embedded in the powder mixture (and the process is termed a "pack cementation" process) or the article is suspended in out-of-contact relation with the powder mixture (and the process is termed a "vapor phase" process).

The source of aluminum may be pure aluminum metal or it may be an alloy or intermetallic containing aluminum, such as $Co_2Al_5$, as disclosed in Benden et al. U.S. Pat. No. 4,132,816; Baldi U.S. Pat. No. 3,958,047 discloses the use of $Ni_3Al$ as the source of aluminum; and Ahuja U.S. Pat. No. 4,332,843 discloses the use of $Fe_2Al_5$. Activators which have been used in the aluminiding process generally include halides of alkali or alkaline earth metals. See, e.g., the aforementioned patent to Benden. Aluminum oxide is the typical diluent added to the powder mixture and controls the aluminum activity of the mixture. Aluminum oxide also prevents the powder mixture from sintering together during the coating process, as discussed in Levine et al. U.S. Pat. No. 3,667,985.

Three problems which have been prevalent, especially in the gas phase aluminiding processes, are the formation of cryolite, $Na_3AlF_6$, on the surface of the coated article; the aggregation of "zipper oxides" on the original substrate surface; and the formation of oxides within the coating itself. Cryolite has been found to accelerate the rate of base metal degradation. While cryolite formation can sometimes be limited by using special aluminiding powder mixtures, the quality of the coatings produced by such mixtures is considered to be not as good as the quality of the coatings produced by powder mixtures that result in cryolite formation. Oxides at the coating-substrate interface, and within the coating itself are undesired, since they also degrade coating properties. The former types of oxides can cause exfoliation of the coating; the latter type can act as fatigue initiation sites and sites for accelerated oxidation degradation.

Notwithstanding the advances made in the aluminiding field, researchers continue in their attempts to provide better coatings. Such coatings must have excellent resistance to oxidation and corrosion attack, and must be resistant to thermal fatigue. The present invention results from such effort.

DISCLOSURE OF INVENTION

Improved gas phase aluminide coatings for nickel and cobalt base superalloys are formed by heating a powder mixture which includes a source of aluminum, a halide activator, and a buffer which is substantially free of aluminum oxide and which controls the aluminum activity in the powder mixture so that an outward diffusing aluminide coating is formed on the article. One powder mixture particularly useful in this invention consists essentially of about, by weight percent, 5–20 $NH_4F.HF$, 10–30 Cr, balance $Co_2Al_5$. Elimination of aluminum oxide as a powder constituent has been found to dramatically improve the quality of the aluminide coating produced. In particular, there is no cryolite formation on the coating surface, and oxide contamination at the coating-substrate interface and within the coating itself is essentially eliminated. The use of ammonium biflouride, $NH_4F.HF$, results in a coating mixture with excellent "throwing power", i.e., the ability to coat internal surfaces of hollow gas turbine blades. Chromium is used as a buffer to control the aluminum activity, so that a thin, outward diffusing aluminide coating of about 0.0005–0.0035 inches is formed. Such thin coatings have excellent resistance to thermal fatigue, and have resistance to oxidation degradation which is comparable to the best prior art aluminide coatings.

Other features of the invention will become apparent to those skilled in the art from the following description and accompanying drawing.

BEST MODE FOR CARRYING OUR THE INVENTION

Figure 1:
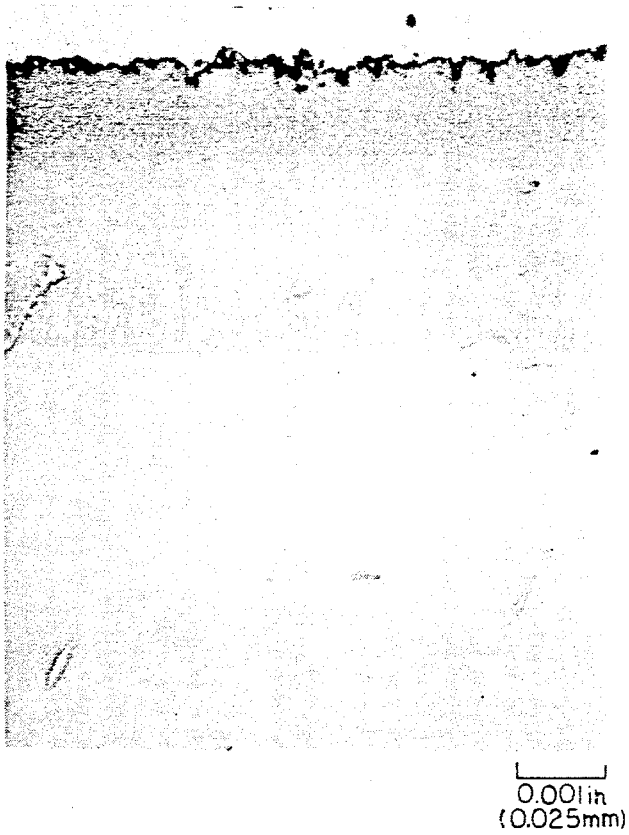
FIG. 1 PRIOR ART
FIG. 1 is a photomicrograph of a prior art, inward diffusing aluminide coating.

The invention is best understood by reference to the Figures. The inward diffusing prior art aluminide coating of FIG. 1 is produced by a powder mixture which has a high aluminum activity. As seen in the Figure, the coating is characterized by a three zone microstructure with considerable phase precipitation in the NiAl rich outer zone. While these types of coatings generally have good resistance to oxidation degradation, they range up to about 0.004 inches thick. Such thick aluminide coatings are known to have relatively poor thermal fatigue resistance.

Figure 2:
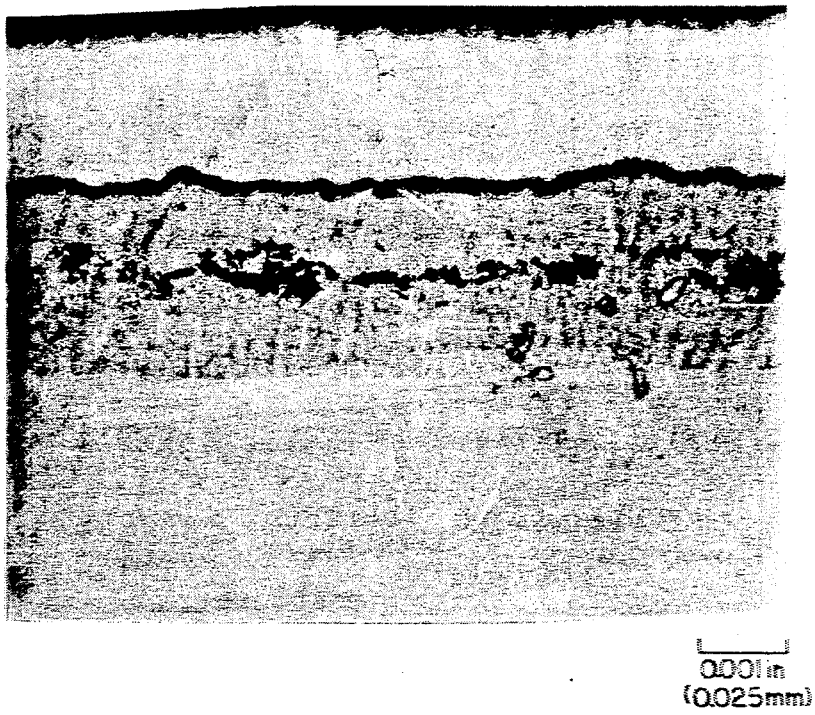
FIG. 2 PRIOR ART
FIG. 2 is a photomicrograph of a prior art, outward diffusing aluminide coating.

The prior art coating shown in FIG. 2 was produced with a powder mixture which contained about 60% by weight aluminum oxide as the diluent. The resulting contamination is clearly evident. The powder mixture had a comparatively lower aluminum activity than the mixture which produced the coating in FIG. 1. As a result, the substrate basis metal (which is nickel in FIG. 2, since the substrate is a nickel base superalloy) has diffused outwardly while the aluminum in the powder mixture diffused inwardly. The majority of the oxide contamination in FIG. 2 are zipper oxides, i.e., oxides at the original substrate interface. As noted above, these oxides can cause the coating to spall during service use.

Figure 3:
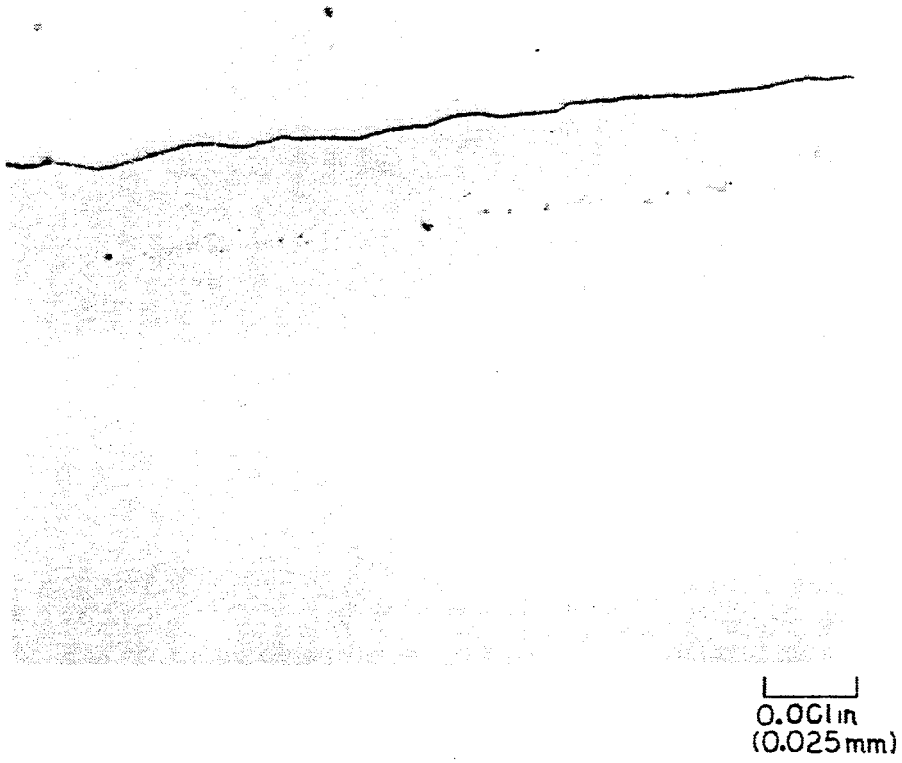
FIG. 3 is a photomicrograph of the outward diffusing aluminide coating of the invention.

As is seen in FIG. 3, the coating of the invention is an outward diffusing coating like the coating in FIG. 2, but is significantly cleaner than the FIG. 2 coating. This factor, in addition to the nominal 0.002 inch coating thickness, results in excellent oxidation resistance as well as resistance to thermal fatigue cracking.

The coating of the invention is produced in the following manner. A powder mixture consisting essentially of, by weight percent, 5-20 $NH_4F.HF$, 10-30 Cr, balance $Co_2Al_5$ is prepared. A nickel base superalloy article is suspended above the mixture and enclosed in a sealed retort similar to that shown in Benden et al U.S. Pat. No. 4,148,275, the contents of which are incorporated by reference. The retort is heated to about 1,900°-2,050° F., and after between about two and twelve hours, a coating similar to that shown in FIG. 3 is produced. The coating has a clean, uncontaminated interface, a metallographically distinguishable two-zone outward diffusing aluminide microstructure, and is about 0.0005-0.0035 inches thick, typically about 0.0015-0.0025 inches thick. It contains about 20-35 weight percent aluminum, along with elements from the substrate.

While $Co_2Al_5$ is the preferred source of aluminum, other sources may be used. Such sources include pure aluminum as well as transition metal alloys of aluminum (e.g., NiAl or $Ni_3Al$). A fluoride containing activator is preferred in the invention, since the use of such activators result in coating mixtures which have very good throwing power. Good throwing power is essential when a gas phase process is used to coat the internal surfaces of a hollow gas turbine engine blade. Ammonium bifluoride, $NH_4F.HF$, is the preferred activator although halides (most preferably fluorides) of alkali or alkaline earth metals may also be useful. In the preferred embodiment, chromium is used as the diluent to control the activity of aluminum in the powder mixture; without the presence of chromium, the mixture will be too active, and a thick, inward diffusing coating would be produced. Elemental silicon may also be used as the buffer. Alloys or mixtures containing chromium and/or silicon may also be used. The powder mixture is substantially free from aluminum oxide, which is widely used as the diluent in most prior art diffusion coating processes. It has been discovered that the presence of aluminum oxide in prior art coating mixtures is the apparent cause of the aforementioned undesired contamination (cryolite and entrapped oxides) which is typically observed in prior art gas phase aluminide coatings. According to the invention, aluminum oxide is removed from the powder mixture, which results in substantially cleaner (i.e., uncontaminated) coatings. While some small amounts of aluminum oxide (about 10% by weight, maximum) may be added to the powder mixture without causing an unacceptable amount of cryolite or oxides to form, the best aluminide coatings will be produced when the mixture is free of aluminum oxide. Powder mixtures containing no more than about 10 percent by weight of aluminum oxide are considered to be "substantially free" of aluminum oxide.

The preferred powder mixture of the invention consists essentially of 5-20 $NH_4F.HF$, 10-30 Cr, up to about 10 $Al_2O_3$, balance $Co_2Al_5$. A preferred range is 7-17 $NH_4F.HF$, 13-23 Cr, balance $Co_2Al_5$. The most preferred powder mixture is about 12 $NH_4F.HF$, 18 Cr, balance $Co_2Al_5$. When nickel base superalloy articles in out-of-contact relation to this most preferred mixture are heated to about 1,975° F. for about four hours, the resultant coatings are typically about 0.0015-0.0025 inches thick. They have comparable resistance to oxidation and corrosion attack as compared to prior art coatings, and better resistance to thermal fatigue cracking.

From the foregoing description, one skilled in the art can easily ascertain the essential characteristics of this invention, and without departing from the spirit and scope thereof, can make various changes and modifications of the invention to adapt it to various uses and conditions.

We claim:

1. A method for forming an aluminide coating on the surface of a substrate selected from the group consisting of nickel and cobalt base alloys, the method comprising the step of heating the substrate in the presence of a powder mixture consisting essentially of, by weight percent, 5-20 $NH_4F.HF$, 10-30 Cr, up to 10 $Al_2O_3$, balance $Co_2Al_5$.

2. The method of claim 1, wherein the substrate is in out-of-contact relation with the powder mixture.

3. A method for forming a gas phase aluminide coating on a nickel or cobalt base superalloy article, comprising the step of heating the article and a powder mixture consisting essentially of cobalt aluminum, ammonium bifluoride and an effective amount of chromium metal to form an outward diffusing aluminide coating, the powder mixture being substantially oxide free.

4. The method of claim 3 conducted to produce a coating of about 0.0005-0.0035 inches.

5. A method for forming a gas phase aluminide coating on a nickel or cobalt base superalloy article, comprising the steps of disposing the article in out-of-contact relation with a powder mixture which consists essentially of about, by weight percent, 5-20 $NH_4F.HF$, 10-30 Cr, up to 10 $Al_2O_3$, balance $Co_2Al_5$, and heating the powder mixture to cause diffusion of aluminum into the article surface.

6. The method of claim 5, wherein the powder mixture consists essentially of about 5-20 $NH_4F.HF$, 10-30Cr, balance $Co_2Al_5$.

7. The method of claim 5, wherein the powder mixture consists essentially of about 7-17 $NH_4F.HF$, 13-23 Cr, balance $Co_2Al_5$.

8. The method of claim 5, wherein the powder mixture consists essentially of about 12 $NH_4F.HF$, 18Cr, 70 $Co_2Al_5$.

9. The method of claim 5, wherein the article and powder mixture are heated at about 1,900°-2,050° F. for about 2-12 hours.

* * * * *